US008499384B2

(12) United States Patent
Zerhusen

(10) Patent No.: US 8,499,384 B2
(45) Date of Patent: Aug. 6, 2013

(54) PENDANT ASSEMBLY WITH REMOVABLE TETHER

(75) Inventor: Robert Mark Zerhusen, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 77 days.

(21) Appl. No.: 13/050,141

(22) Filed: Mar. 17, 2011

(65) Prior Publication Data

US 2012/0233774 A1 Sep. 20, 2012

(51) Int. Cl.
*A47C 21/08* (2006.01)
*A47C 21/00* (2006.01)

(52) U.S. Cl.
USPC ..... 5/425; 5/424

(58) Field of Classification Search
USPC ..... 5/177, 184, 204, 217, 425, 663, 426–430, 5/503.1, 658; 292/1, 32, 33, 37, 41, 42, 137, 292/138, 140, 145, 163, 169, 174, 175, 177, 292/179; 70/14, 58; 24/457
See application file for complete search history.

(56) References Cited

U.S. PATENT DOCUMENTS 1,899,982 A * 3/1933 Olson ..... 24/335
1,946,384 A * 2/1934 Baril et al. ..... 70/280
1,985,787 A * 12/1934 Le Bourveau ..... 292/33
2,523,170 A * 9/1950 Wickerham ..... 200/43.01
4,740,020 A * 4/1988 Williams ..... 292/41
5,299,721 A * 4/1994 Cummings ..... 224/406
5,975,592 A * 11/1999 Lin ..... 292/37
5,987,670 A * 11/1999 Sims et al. ..... 5/600
5,991,947 A * 11/1999 Lavin et al. ..... 5/600
6,008,598 A * 12/1999 Luff et al. ..... 318/16
6,038,718 A * 3/2000 Pennington et al. ..... 5/618
6,320,510 B2 11/2001 Menkedick et al.
6,351,678 B1 2/2002 Borders
6,366,328 B1 4/2002 Vanderpohl, III et al.
6,396,224 B1 5/2002 Luff et al.
6,467,111 B1 * 10/2002 Vrzalik et al. ..... 5/600
6,486,792 B1 11/2002 Moster et al.
6,658,680 B2 12/2003 Osborne et al.
6,662,602 B1 * 12/2003 Carl ..... 70/58
6,691,346 B2 2/2004 Osborne et al.
6,761,344 B2 7/2004 Welling et al.
6,781,517 B2 8/2004 Moster et al.
6,854,145 B2 * 2/2005 Ruehl et al. ..... 5/600
6,941,598 B2 * 9/2005 Ferrand et al. ..... 5/600
7,073,220 B2 * 7/2006 Simmonds et al. ..... 5/428
7,083,355 B2 * 8/2006 Jensen et al. ..... 403/92
7,179,012 B2 * 2/2007 Bedi ..... 403/325
7,200,882 B2 * 4/2007 Heimbrock ..... 5/430
7,273,115 B2 9/2007 Kummer et al.
7,430,771 B2 10/2008 Heimbrock
7,480,951 B2 * 1/2009 Weismiller et al. ..... 5/600
7,686,354 B2 * 3/2010 Jasper ..... 292/33
7,904,976 B2 * 3/2011 Hakamiun et al. ..... 5/53.1
2003/0137151 A1 * 7/2003 Eggum ..... 292/98
2006/0056616 A1 * 3/2006 Heimbrock ..... 379/428.01

(Continued)

*Primary Examiner* — Michael Trettel
*Assistant Examiner* — Myles Throop
(74) *Attorney, Agent, or Firm* — Barnes & Thornburg LLP

(57) ABSTRACT

A pendant assembly includes a pendant and a tether. The pendant and tether are configured so that the tether can be removed from the pendant when the pendant is secured to a person-support apparatus, and so that the tether remains attached to the pendant when the pendant is removed from the person-support apparatus.

21 Claims, 8 Drawing Sheets

U.S. PATENT DOCUMENTS

2006/0058587 A1* 3/2006 Heimbrock et al. ..... 600/300
2007/0141869 A1* 6/2007 McNeely et al. ..... 439/76.1
2008/0010747 A1* 1/2008 Dixon et al. ..... 5/600
2008/0211238 A1* 9/2008 Stevens ..... 292/163
2009/0015027 A1 1/2009 Lambarth et al.
2009/0233495 A1* 9/2009 Sproesser ..... 439/754
2010/0031446 A1* 2/2010 Wyslucha ..... 5/658
2011/0113558 A1* 5/2011 Olszewski ..... 5/658
2011/0247137 A1* 10/2011 Herman et al. ..... 5/600
2012/0262860 A1* 10/2012 Seibert et al. ..... 361/679.02
2012/0317779 A1* 12/2012 Myers et al. ..... 29/428

* cited by examiner

PENDANT ASSEMBLY WITH REMOVABLE TETHER

BACKGROUND

This disclosure relates generally to user controls for a person-support apparatus that has one or more electronically controllable features. Such control devices may be referred to as controllers or pendants. Some examples of such devices are disclosed in, for example, U.S. Pat. Nos. 6,320,510; 6,366,328; 6,396,224; 6,486,792; 6,658,680; 6,691,346; 6,761,344; 6,781,517; and 7,200,882.

More particularly, but not exclusively, this disclosure relates to a portable user control that can be stored when not in use.

SUMMARY

The present disclosure includes one or more of the features recited in the appended claims and/or the following features which, alone or in any combination, may comprise patentable subject matter.

According to one aspect of this disclosure, a siderail assembly includes a siderail configured to be coupled to a person-support apparatus. The siderail assembly includes a first surface, a second surface spaced from the first surface, and an edge extending between the first and second surfaces. The edge defines an opening in the siderail.

The siderail assembly includes a pendant configured to control at least one function of the person-support apparatus. The pendant includes a housing, a user interface supported by the housing, and a power source. The housing is sized to fit within the opening in the siderail. The siderail assembly also includes a locking mechanism configured to secure the pendant to the siderail; and a tether configured to engage the locking mechanism of the pendant to permit the pendant to be uncoupled from the siderail when the tether is engaged with the locking mechanism and to permit the tether to be uncoupled from the pendant when the pendant is secured to the siderail.

The power source may be rechargeable. The siderail assembly may include an inductive charging mechanism having a first portion located in the pendant and a second portion located in the siderail.

The siderail assembly may include a coiling mechanism configured to receive the tether when the tether is uncoupled from the pendant. The siderail assembly may include a key mechanism coupled to the tether. The key mechanism may be insertable into a receptacle of the pendant to uncouple the pendant from the siderail. The key mechanism may include a tip. The locking mechanism may include a block supported by the pendant. The tip may be configured to move the block to uncouple the pendant from the siderail.

The siderail assembly may include an actuator coupled to the tether. The actuator may be configured to uncouple the tether from the pendant. The siderail assembly may include a safety mechanism coupled to the actuator and configured to deter unauthorized uncoupling of the tether from the pendant.

According to another aspect of this disclosure, an apparatus includes a frame; a support member coupled to the frame, the support member defining a docking area; and a pendant configured to wirelessly control an electronically-controllable function of a person-support apparatus. The pendant is sized to fit securely within the docking area. The person-support apparatus also includes a tether releasably coupled to the pendant; and a locking mechanism configured to enable the pendant to be released from the docking area when the tether is coupled to the pendant and to enable the tether to be released from the pendant when the pendant is secured within the docking area.

The frame may be adjustable to support a person in a plurality of positions including a horizontal position. The support member may be one of a siderail, headboard, and footboard. The docking area may be an opening defined in the support member.

The person-support apparatus may include a coiling mechanism coupled to the frame. The coiling mechanism may be configured to receive the tether when the tether is released from the pendant.

The person-support apparatus may include a first inductive coil located in a hollow region of the support member. The person-support apparatus may include a second inductive coil located in the pendant.

The apparatus to which the pendant may be docked may be patient furniture, healthcare furniture, healthcare equipment, healthcare device, and support structure of a patient room. For example, the apparatus may be a patient chair, table, bedside cabinet, or overbed table; or a healthcare device or equipment, such as a service arm, headwall, footwall, patient lift, care cart or other such device, structure or equipment. The apparatus may include any structure that can be used by a patient or located in the vicinity of a patient, including a wall or other support structure of a patient's room or washroom.

According to another aspect of this disclosure, a pendant assembly includes a housing configured to be removably couplable to a docking area of a person-support apparatus; a user interface supported by the housing and configured to receive an input from a user; a power source configured to supply power to the user interface; a locking mechanism supported by the housing, and a tether releasably couplable to the locking mechanism to enable the pendant to be released from the docking area when the tether is coupled to the pendant and to enable the tether to be released from the pendant when the pendant is secured within the docking area.

The pendant assembly may include a block movable relative to the housing to selectively engage the person-support apparatus. The pendant assembly may include a tip coupled to the tether and a first block coupled to the locking mechanism. The tip may be configured to move the first block from a first position in which the tether is uncoupled from the locking mechanism to a second position in which the tether is coupled to the locking mechanism.

The pendant assembly may include a slot coupled to the tether and a finger coupled to the locking mechanism. The slot may be configured to receive the finger when the tether is coupled to the locking mechanism. The pendant assembly may include a second block coupled to the finger and configured to engage a surface of the person-support apparatus when the tether is uncoupled from the locking mechanism. The first and second blocks may be spring-loaded.

Additional features alone or in combination with any other feature(s), including those listed above and those listed in the claims and those described in detail below, may comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
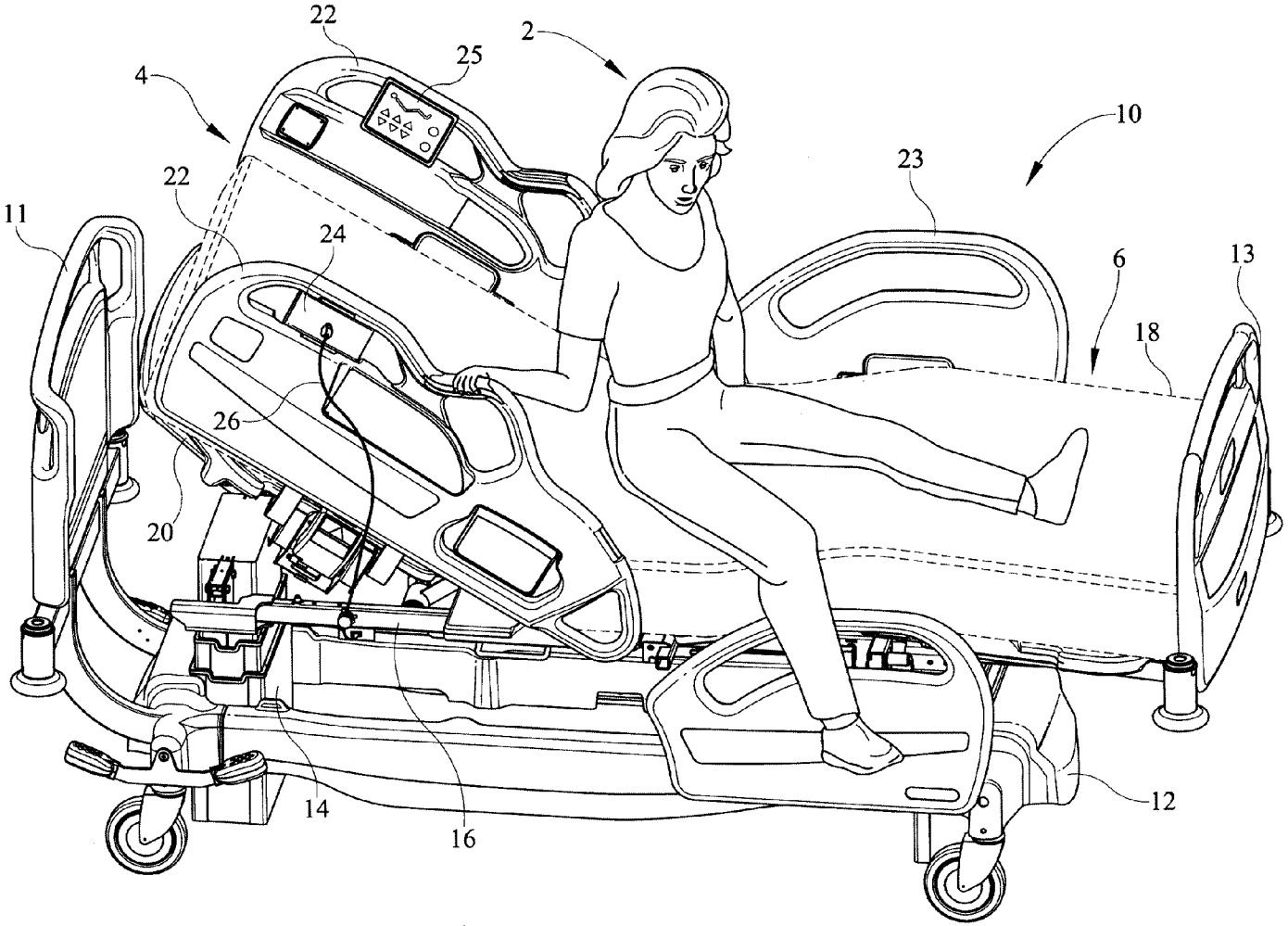
FIG. 1 is a perspective view of a person-support apparatus with a pendant assembly coupled thereto according to one illustrative embodiment of this disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

As shown by FIGS. 1-8, a pendant 24 is attachable to an apparatus 10 by a tether 26. In the illustrative embodiments of the present disclosure, the apparatus is a person-support apparatus. However, this disclosure contemplates other embodiments in which the apparatus 10 includes healthcare furniture, such as a patient chair, table, bedside cabinet, or overbed table; or a healthcare device or equipment, such as a service arm, headwall, footwall, patient lift, care cart or other such device, structure or equipment. In general, it is contemplated that the apparatus 10 may include any structure that can be used by a patient or located in the vicinity of a patient, including a wall or other support structure of a patient's room or washroom.

The illustrated person-support apparatus 10 is a bed, which is designed to support a person in a seated or a laying-down position. The person-support apparatus 10 is of a type that is typically used in hospitals and other facilities in which health care is provided. More specifically, the person-support apparatus 10 is of a type that can support a person in a variety of positions, including positions intermediate the laying-down position and the seated position, and includes a number of features that are controlled electronically by an on-board control unit (not shown). However, this disclosure applies to any type of bed or similar structure, including but not limited to stretchers, tables, chairs, and other devices designed to support a person, whether or not all of the features of the illustrated person-support apparatus 10 are included in such structure, and whether or not such person-support structure includes other features not mentioned herein.

The pendant 24 includes a user interface, which may include one or more user controls 25. The user controls 25 are, in general, devices that output an electrical signal in response to a stimulus, such as the application of force or pressure or a voice command (e.g., switches, dials, levers, slides, buttons, touchscreen controls, or the like).

One or more of the user controls 25 is selectable to actuate an electronically-controlled feature of the person-support apparatus 10. Some examples of electronically-controllable features of a person-support apparatus include adjusting the position, length, or width of the person-support apparatus, raising, lowering, or pivoting a section of the person-support apparatus, weighing a person positioned on the person-support apparatus, inflating, deflating, or adjusting inflation in one or more sections of a mattress, and laterally rotating a person positioned on the person-support apparatus, to name a few.

One or more others of the user controls 25 may be configured to control a feature or features of other electronically-controlled devices that may be provided in a room occupied by a person, such as a television, movie player, radio, music player, computer, heat source, air conditioner, patient-nurse communication system, room lighting, furniture, or medical equipment, to name a few.

Figure 8:
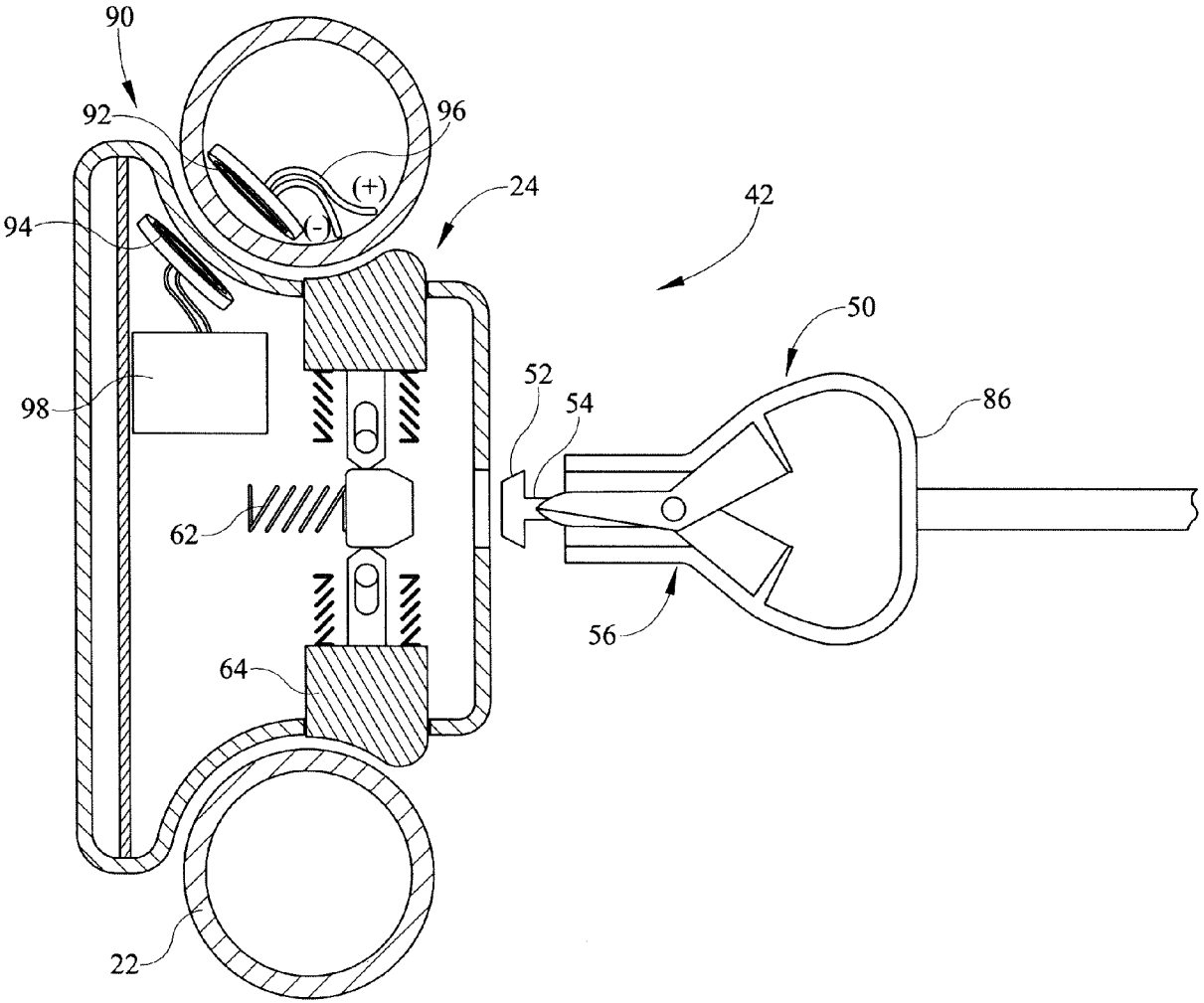
FIG. 8 is a partially sectional view of another illustrative embodiment of a pendant assembly, showing a recharging feature.

The pendant 24 communicates wirelessly with the control unit of the person-support apparatus 10 and with any other devices that are controlled by the user controls 25. Any suitable technique for wirelessly communicating control signals to a remote device may be used, including infrared, RF, Wi-Fi, or the like. The pendant 24 includes an on-board power supply, such as a non-rechargeable battery (e.g. a 9-Volt battery) or a rechargeable battery, which powers the generation and wireless transmission of electrical signals in response to actuation of one or more of the user controls 25. One example of an on-board power supply 98 is shown in FIG. 8, which is described below.

The person-support apparatus 10 includes a base 12, a plurality of supports 14 coupled with the base 12, and a frame 16 supported above the base 12 by the supports 14. The person-support apparatus 10 further includes an articulating deck 20, which is supported by the frame 16. In some embodiments, the person-support apparatus 10 may include a person-support surface 18 (e.g., a mattress) supported by the deck 20. Irrespective of its configuration (e.g. with or without a surface 18), the person-support apparatus 10 is designed to support a person 2.

The person-support apparatus 10 has a head end 4, where the head of the person 2 can be positioned, and a foot end 6, where the feet of the person 2 can be positioned.

The person-support apparatus 10 may include a headboard 11 and/or a footboard 13. The headboard 11 and footboard 13 may be coupled to the head end 4 and the foot end 6 of the person-support apparatus, respectively. The person-support apparatus 10 further includes a plurality of head-end siderails 22 and a plurality of foot-end siderails 23, which may be supported by the deck 20 and/or the frame 16. As shown in FIG. 1, at least one of the siderails 22, 23 may be moved to a lower position to facilitate egress of the person 2 from the person-support apparatus 10.

In the illustrated embodiments, the pendant 24 is designed to be secured to a docking area 36 of the person-support apparatus 10; here, an opening in one or more of the head end siderails 22. However, this disclosure contemplates that the pendant 24 may, alternatively or in addition, be secured elsewhere, for example, within an opening in one or more of the foot end siderails 23, the headboard 11, or the footboard 13, or to another suitable docking area. In general, any configuration of the pendant 24 that enables it to be secured to a docking area (e.g., between two opposing perimeter edges of a person-support apparatus) may be used. Moreover, multiple pendant assemblies 24 may be used with the person-support apparatus 10, each being securable to a docking area as described herein.

Figure 2:
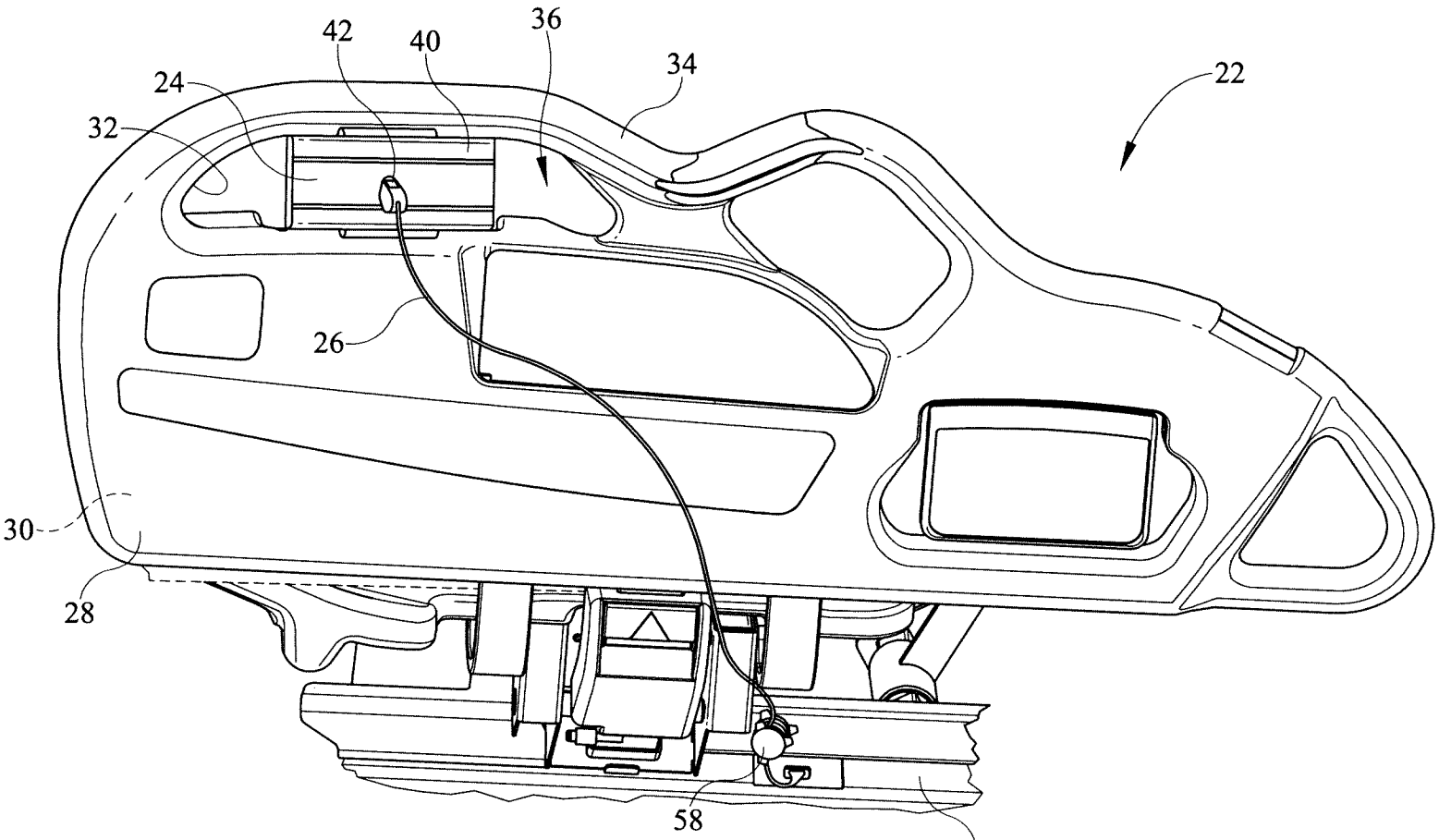
FIG. 2 is a perspective view of a portion of the person-support apparatus of FIG. 1, showing in greater detail the pendant assembly secured thereto.
Figure 3:
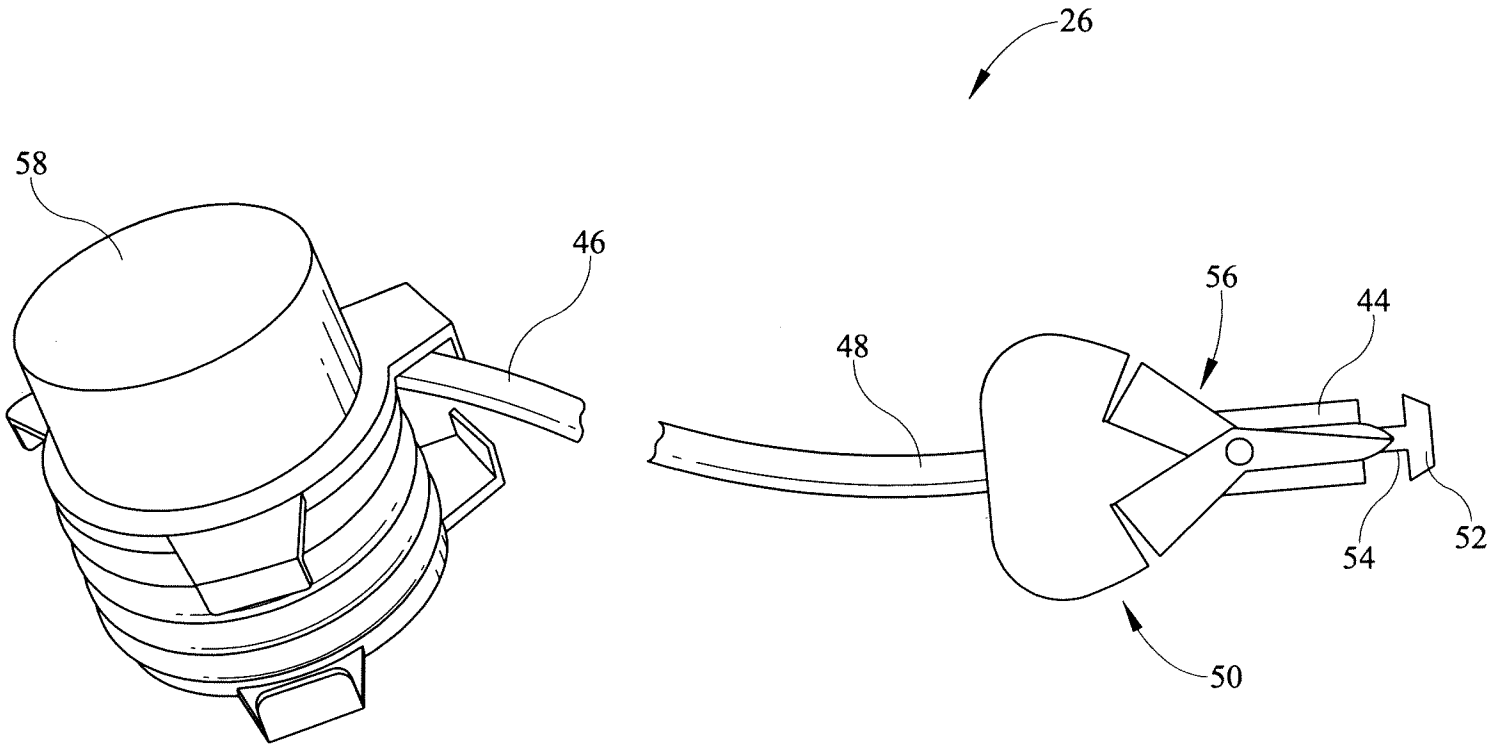
FIG. 3. is a partial perspective view of the tether of the pendant assembly of FIG. 1.

Referring to FIGS. 2-3, the tether 26 includes a cable (internal thereto) having an end 44 and an end 46, which is spaced from the end 44. The cable is covered by a tether housing 48, which is made from an insulating material such as rubber or plastic.

One end 46 of the tether 26 is coupled to the person-support apparatus 10 via a terminus 58, which is attached (e.g. by screws, rivets, adhesive, or other suitable fastener) to the deck 20. In the illustrated embodiment, the terminus 58 is a coiling mechanism, which retracts the tether 26 therein when the tether 26 is disconnected from the pendant assembly 26. The coiling mechanism 58 is configured to roll back the tether 26 when the tether 26 is not connected to the pendant 24. The coiling mechanism 58 is provided with a spring loaded mechanism, which is configured to automatically roll the tether 26 back into the coiling mechanism 58 when the tether 26 is released from the pendant 24.

When the other end 44 of the tether 26 is inserted into the pendant assembly 26, the pendant 24 can be secured within the docking area 36 of the person-support apparatus 10 as described below. The length of the tether 26 (e.g. between the ends 44, 46) may be any suitable length that is sufficient to enable the pendant 24 to be docked to any apparatus 10 (whether it be a person-support apparatus as shown in the drawings or another type of supporting apparatus, such as any of those listed above) while the end 46/terminus 58 is secured to the person-support apparatus or another location.

The siderail 22 has a first surface 28 facing away from the patient 2, a second surface 30 facing toward the patient 2, an edge 32 and a grip portion 34. The first surface 28 and the second surface 30 are spaced apart and the edge 32 extends therebetween. The edge 32 defines the docking area 36, which is an opening that is sized to releasably hold the pendant 24 therein.

A housing 40 is configured to support the components of the pendant 24. This disclosure contemplates that the housing 40 may also support one or more other materials or devices that may need to be accessible to a person, such as an accessory module, fluid dispenser, tissue holder, electronics port, or the like.

Referring to FIGS. 4-8, the pendant 24 includes a locking mechanism 42. The locking mechanism 42 is configured to prevent the pendant 24 from being removed from the docking area 36 once the pendant housing 40 has been securely coupled thereto, and to prevent the tether 26 from being removed from the pendant 24 when the pendant 24 is removed from the docking area 36.

The locking mechanism 42 is controlled by the tether 26. The tether 26 includes a key mechanism 50, which is configured to lock and unlock the pendant 24 from the docking area 36.

The key mechanism 50 includes a tip 52, a pair of opposing slots 54 and an actuator 56, which are located at the end 44 of the tether 26. When the tether 26 is connected to the pendant 24, the pendant 24 can be removed from the docking area 36. However, the pendant 24 remains connected to the tether 26 when the pendant 24 is removed from the docking area 36. This may reduce the chances of the pendant being misplaced. When the pendant 24 is securely coupled to the docking area 36, the tether 26 can be removed from the pendant 24. Once removed from the pendant 24, the tether 26 can be rolled back in to the coiling mechanism 58 and the pendant 24 is locked into the docking area 36 once again.

The pendant housing 40 includes a face 74, which normally supports one or more of the user controls 25, and a backing 76. A portion of the locking mechanism 42 is supported by the housing 40, between the face 74 and the backing 76. The portion of the locking mechanism 42 located at the pendant 26 includes a pair of opposing blocks 64, which are located between the face 74 and the backing 76. Each of the blocks 64 is movable relative to the housing 40. Each of the blocks 64 has an outwardly facing side that can engage a portion of the docking area 36. In the illustrated embodiments, the outwardly facing sides of the blocks 64 are configured to securely engage a portion of the siderail 22.

Figure 4:
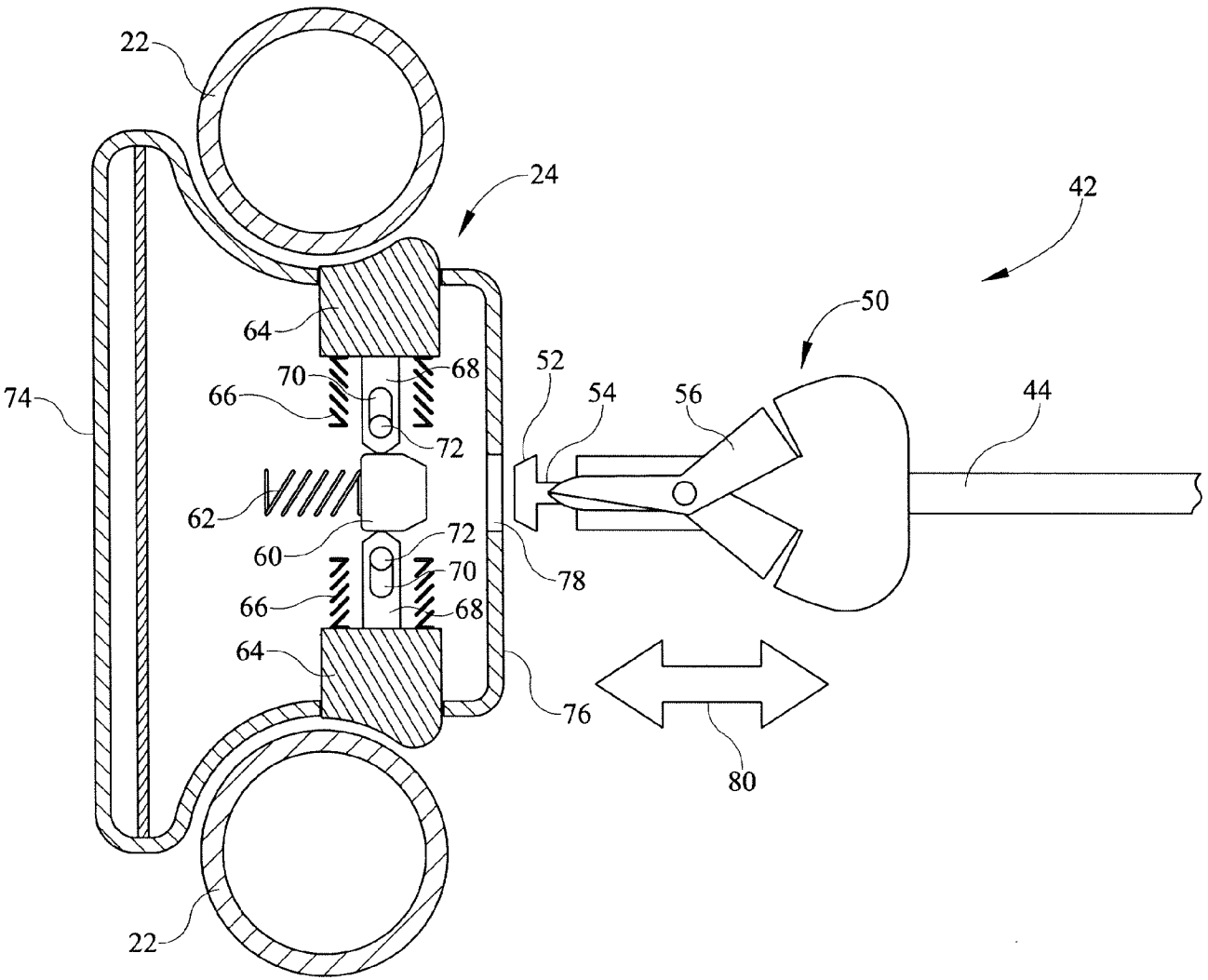
FIG. 4 is a partially sectional side view of the pendant assembly of FIG. 1 showing the pendant housing secured to the person-support apparatus and the tether removed from the pendant.
Figure 5:
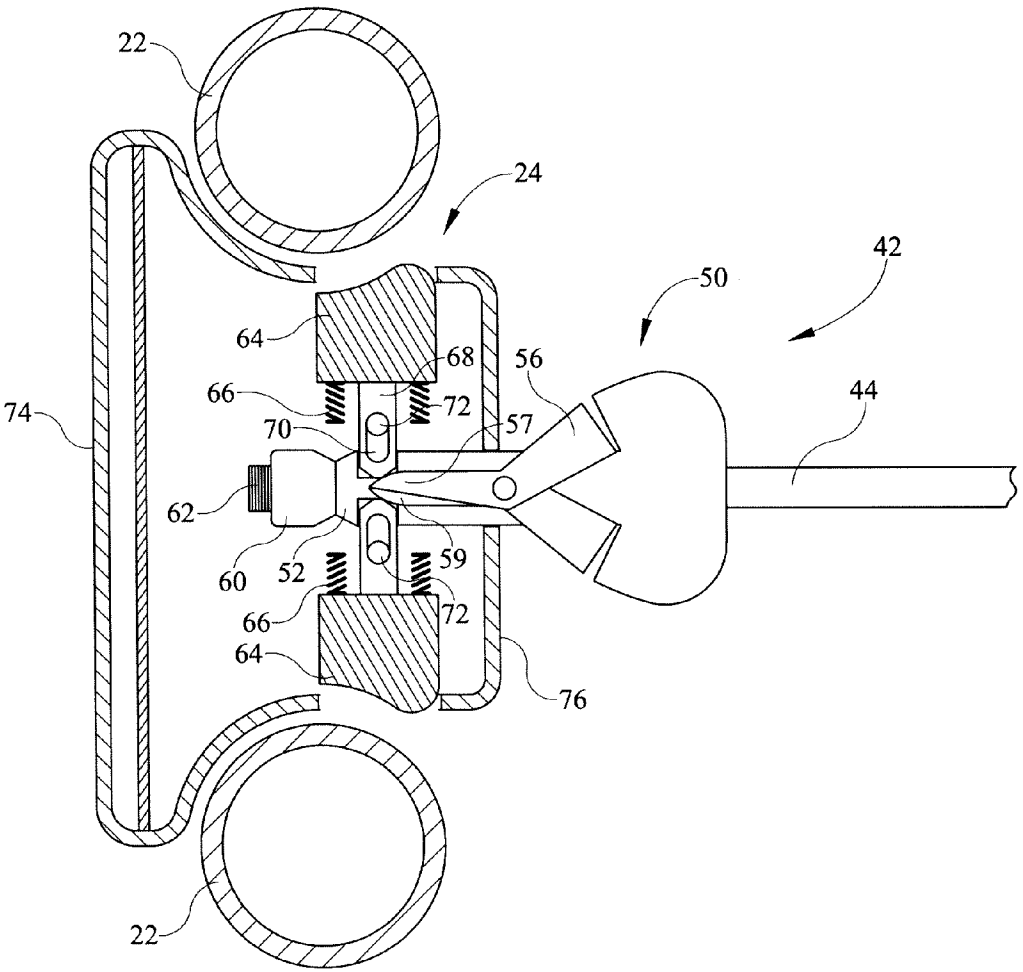
FIG. 5 is a partially sectional side view of the pendant assembly of FIG. 1 showing the tether engaged with the pendant and the pendant housing released from the person-support apparatus.
Figure 6:
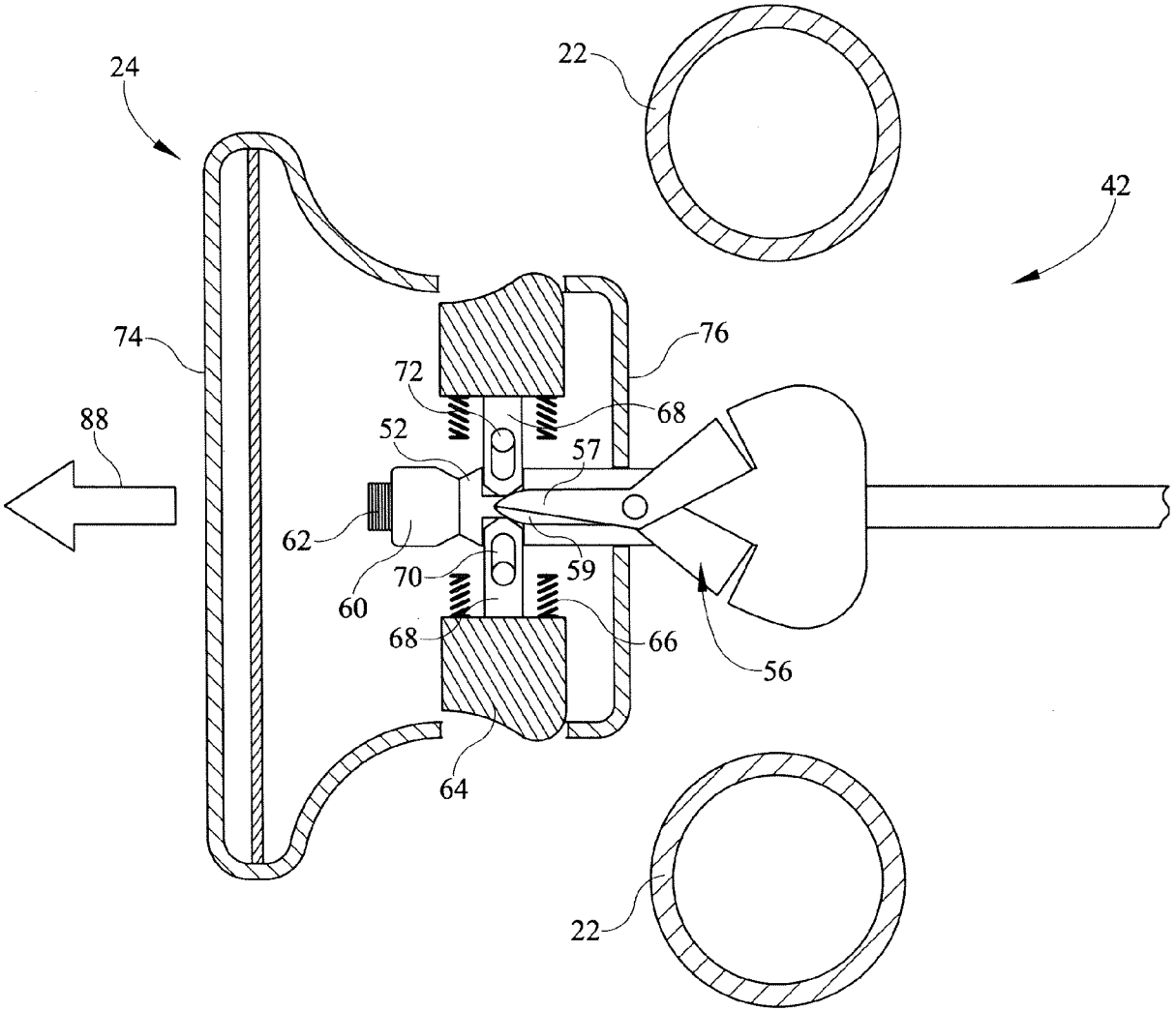
FIG. 6 is a partially sectional side view of the pendant assembly fully removed from the person-support apparatus.
Figure 7:
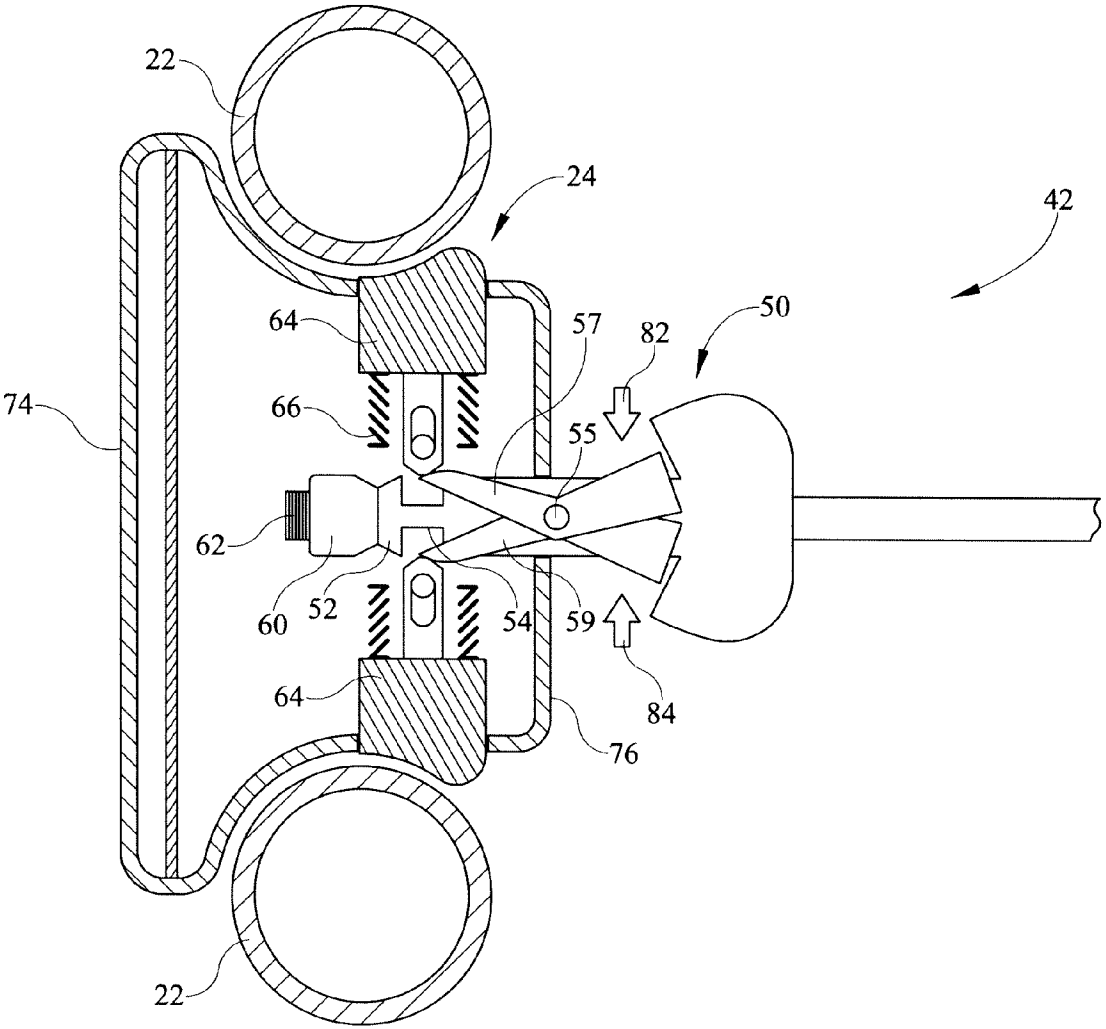
FIG. 7 is a partially sectional side view of the pendant assembly, showing the pendant housing being secured to the person-support apparatus, with the tether being released.

Each of the blocks 64 is movable between two positions: an extended position as shown in FIGS. 4, 7, and 8, and a retracted position, as shown in FIGS. 5 and 6, by the action of a spring 66 and a finger 68, which are movable with the block 64. A proximal end of the finger 68 and a proximal end of the spring 66 are each coupled to an end of the block 64 which is spaced from the portion of the block 64 that is configured to engage the docking area 36. The distal end of the finger 68 has a slot 70 defined therein. A pin 72 resides in the slot 70. The finger 68 is movable relative to the pin 72.

Also supported by the housing 40 is a block 60, which is movable between two positions by the action of a spring 62. The pin 72 and the distal end of each of the springs 62, 66 are fixedly secured to interior portions of the housing 40 (e.g. interior walls or supports).

In the illustrated embodiments, the blocks 64 move linearly inwardly and outwardly relative to the housing 40 along an axis, while the block 60 moves linearly forwardly and backwardly relative to the housing 40 along another axis that is substantially perpendicular to the direction of movement of the blocks 64. More particularly, the illustrated docking area 36 is vertically oriented. As a result, the blocks 64 move upwardly and downwardly relative to the housing 40 along a substantially vertical axis, while the block 60 moves back and forth relative to the housing 40 along a substantially horizontal axis (e.g., in the directions shown by the double-headed arrow 80). However, it will be understood that the relative directions of movement of the blocks 60, 64 will depend on the configuration of the docking area 36 and the orientation of the housing 40 when placed therein, according to the requirements of a particular embodiment.

In one position, shown in FIG. 4, the pendant 24 is securely coupled to the docking area 36 (in this case, the docking area 36 is located in one of the siderails 22), and the tether 26 is removed. If a user wants to remove the pendant 24 from the docking area 36, the key mechanism 50 is inserted into a receptacle 78 of the pendant 24. As a result of insertion, the tip 52 of the key mechanism 50 moves the block 60 in the same direction as the insertion motion, resulting in the compression of the spring 62.

As the spring 62 is compressed, the slots 54 fill the space previously occupied by the block 60, and the distal end of each finger 68 moves into one of the slots, respectively. Movement of the fingers 68 into the slots 54 locks the tether 26 to the pendant 24. As a result, each of the blocks 64 moves inwardly toward the housing 40, with the expansion of the springs 66. This results in the blocks 64 being disengaged from the docking area 36 (e.g. the siderail 22), as shown in FIG. 5. Disengagement of the blocks 64 releases the pendant 24 from the docking area 36 in the direction of arrow 88, but the pendant 24 remains attached to the tether 26 as shown in FIG. 6. In this position, the pendant 24 is unlocked from the docking area 36 and can be used in areas reachable by the tether 26 (e.g., areas that are nearby the person-support apparatus 10) with less risk of the pendant 24 being misplaced.

If a user wants to secure the pendant 24 back into the docking area 36, the user places the pendant 24 in the docking area 36 and activates an actuator 56. The actuator 56 is configured to release the tether 26 from the pendant 24 upon receipt of a stimulus, such as the application of force or pressure. Although not specifically shown in FIGS. 1-7, a safety mechanism is normally provided in connection with the actuator 56, so that only authorized personnel can activate the actuator 56. The safety mechanism may include a lever, button, pin or receptacle that is provided at a remote location on the key mechanism 50 or is inset so as to require activation by a key, a pen or another device but which cannot be activated by a normal squeezing or pressing motion of a human hand or finger.

Once the safety mechanism is released, the activation of the actuator 56 (e.g. by applying pressure in the directions illustrated by the arrows 82, 84) pivots arms 57, 59 in opposite directions about a pivot 55. Distal ends of the arms 57, 59 force the fingers 68 away from the slots 54, resulting in the compression of the springs 66 and movement of the blocks 64 outwardly relative to the housing 40, as shown in FIG. 7.

The movement of the fingers 68 away from the slots 54 enables the spring 62 to decompress. As a result, the tip 52 moves in a direction opposite the direction of insertion, and the block 60 is once again placed between the fingers 68. This results in engagement of the blocks 64 with the siderail 22, and thus the locking of the pendant 24 back into the docking area as shown in FIG. 4. Once the tether 26 is released from the pendant 24, the tether 26 can be rolled back into the coiling mechanism 58 and stored safely.

FIG. 8 illustrates an embodiment in which a protective sheath 86 serves as part of the safety mechanism described above. The sheath 86 conceals the actuator 56 from normal view.

Also shown in the embodiment of FIG. 8 is a recharging mechanism 90 for the pendant 24. As noted above, the pendant 24 may be powered by a rechargeable battery. The recharging mechanism 90 includes an inductive coil 92, which is fixedly located within a hollow interior region of the siderail 22 (or other structure defining the docking area 36). The coil 92 is connected to a power supply 96, which is illustrated schematically in FIG. 8 but which typically includes wiring that is connected to a main power supply of the person-support apparatus 10.

The recharging mechanism 90 also includes an inductive coil 94, which is coupled to a rechargeable battery 98. Both the coil 94 and the battery 98 are fixedly located within the pendant 24. The coil 94 is positioned within the housing 40 so that when the pendant 24 is secured to the docking area 36, a contactless, wireless electrical field is created between the coils 92, 94 (i.e. without the coils 92, 94 physically touching each other). The wireless activity field created between the coils 92, 94 creates a transfer of electrical energy from the coil 92 to the coil 94, and then from the coil 94 to the battery 98.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A siderail assembly, comprising:

a siderail configured to be coupled to a person-support apparatus and include a first surface, a second surface, an edge extending between the first and second surfaces, the edge defining an opening in the siderail;

a pendant configured to control at least one function of the person-support apparatus, the pendant including a housing, a user interface supported by the housing, and a power source, the housing being sized to fit within the opening in the siderail;

a locking mechanism configured to secure the pendant to the siderail;

a tether configured to engage the locking mechanism of the pendant to permit the pendant to be uncoupled from the siderail when the tether is engaged with the locking mechanism and to permit the tether to be uncoupled from the pendant when the pendant is secured to the siderail; and a key mechanism coupled to the tether, the key mechanism being insertable into a receptacle of the pendant to uncouple the pendant from the siderail.

2. The siderail assembly of claim 1, wherein the key mechanism comprises a tip, and the locking mechanism comprises a block supported within the pendant, and the tip is configured to move the block to uncouple the pendant from the siderail.

3. The siderail assembly of claim 1, wherein the tether is configured to engage the locking mechanism of the pendant to prevent the pendant from being uncoupled from the siderail when the tether is not engaged with the locking mechanism and to permit the tether to be uncoupled from the pendant when the pendant is secured to the siderail.

4. The siderail assembly of claim 1, wherein the power source is rechargeable, and the siderail assembly comprises an inductive charging mechanism having a first coil located in the pendant and a second coil located in the siderail.

5. The siderail assembly of claim 1, comprising a coiling mechanism configured to receive the tether when the tether is uncoupled from the pendant.

6. A siderail assembly, comprising:

a siderail configured to be coupled to a person-support apparatus and include a first surface, a second surface, an edge extending between the first and second surfaces, the edge defining an opening in the siderail;

a pendant configured to control at least one function of the person-support apparatus, the pendant including a housing, a user interface supported by the housing, and a power source, the housing being sized to fit within the opening in the siderail;

a locking mechanism configured to secure the pendant to the siderail;

a tether configured to engage the locking mechanism of the pendant to permit the pendant to be uncoupled from the siderail when the tether is engaged with the locking mechanism and to permit the tether to be uncoupled from the pendant when the pendant is secured to the siderail; and an actuator coupled to the tether, the actuator being configured to uncouple the tether from the pendant.

7. The siderail assembly of claim 6, comprising a sheath concealing the actuator to deter unauthorized uncoupling of the tether from the pendant.

8. An apparatus, comprising:

a frame;

a support member coupled to the frame, the support member defining a docking area;

a pendant configured to wirelessly control an electronically-controllable function of a person-support apparatus, the pendant being sized to fit securely within the docking area;

a tether releasably coupled to the pendant;

a locking mechanism configured to enable the pendant to be released from the docking area when the tether is coupled to the pendant and to prevent the tether from being released from the pendant when the pendant is not secured within the docking area; and a key mechanism coupled to the tether, the key mechanism being insertable into a receptacle of the pendant to uncouple the pendant from the docking area.

9. The apparatus of claim 8, wherein the frame is adjustable to support a person in a plurality of positions including a horizontal position.

10. The apparatus of claim 8, wherein the support member is one of a siderail, headboard, and footboard.

11. The person-support apparatus of claim 8, wherein the docking area is an opening defined in the support member.

12. The apparatus of claim 8, comprising a coiling mechanism coupled to the frame, wherein the coiling mechanism is configured to receive the tether when the tether is released from the pendant.

13. The apparatus of claim 8, comprising a first inductive coil located in a hollow region of the support member.

14. The apparatus of claim 13, comprising a second inductive coil located in the pendant.

15. The apparatus of claim 8, wherein the frame is a component of one of a patient furniture, a healthcare furniture, a healthcare equipment, a healthcare device, and a support structure of a patient room.

16. A pendant assembly, comprising:

a housing configured to be removably coupleable to a docking area of a person-support apparatus;

a user interface supported by the housing and configured to receive an input from a user;

a power source configured to supply power to the user interface;

a locking mechanism supported by the housing;

a tether releasably couplable to the pendant assembly to enable the pendant assembly to be released from the docking area only when the tether is coupled to the pendant assembly and to enable the tether to be released from the pendant assembly when the pendant assembly is secured within the docking area; and a key mechanism coupled to the tether, the key mechanism being insertable into a receptacle of the housing to uncouple the pendant assembly from the docking area.

17. The pendant assembly of claim 16, comprising a block movable relative to the housing to selectively engage the person-support apparatus.

18. A pendant assembly, comprising:

a housing configured to be removably coupleable to a docking area of a person-support apparatus;

a user interface supported by the housing and configured to receive an input from a user;

a power source configured to supply power to the user interface;

a locking mechanism supported by the housing, a tether releasably couplable to the pendant to enable the pendant to be released from the docking area when the tether is coupled to the pendant and to enable the tether to be released from the pendant when the pendant is secured within the docking area; and a tip coupled to the tether and a first block coupled to the locking mechanism, wherein the tip is configured to move the first block from a first position in which the tether is uncoupled from the pendant to a second position in which the tether is coupled to the pendant.

19. The pendant assembly of claim 18, comprising a slot adjacent the tip and a finger coupled to the locking mechanism, wherein the slot is configured to receive the finger when the tether is coupled to the locking mechanism.

20. The pendant assembly of claim 19, comprising a second block, wherein the second block is coupled to the finger and configured to engage a surface of the person-support apparatus when the tether is uncoupled from the pendant assembly.

21. The pendant assembly of claim 20, wherein the first and second blocks are spring-loaded.

* * * * *